US008312639B2

(12) United States Patent
Bae et al.

(10) Patent No.: US 8,312,639 B2
(45) Date of Patent: Nov. 20, 2012

(54) LIQUID STORAGE CONTAINER AND CLOTHES DRYER HAVING THE SAME

(75) Inventors: Sang-Hun Bae, Changwon (KR); Min-Ji Kim, Changwon (KR); Ye-Ji Um, Changwon (KR); Myung-Shik Kim, Changwon (KR); Young-Soo Ha, Changwon (KR)

(73) Assignee: LG Electronics, Inc., Seoul (KR)

( * ) Notice: Subject to any disclaimer, the term of this patent is extended or adjusted under 35 U.S.C. 154(b) by 593 days.

(21) Appl. No.: 12/585,848

(22) Filed: Sep. 25, 2009

(65) Prior Publication Data

US 2010/0077631 A1 Apr. 1, 2010

Related U.S. Application Data

(60) Provisional application No. 61/136,711, filed on Sep. 26, 2008.

(30) Foreign Application Priority Data

Sep. 26, 2008 (KR) ..... 10-2008-0094954

(51) Int. Cl.
*F26B 19/00* (2006.01)

(52) U.S. Cl. ..... 34/89; 34/595; 34/610; 68/12.15; 68/12.23; 8/159

(58) Field of Classification Search ..... 34/89, 90, 34/595, 601, 606, 610; 68/12.15, 12.23; 8/159

See application file for complete search history.

(56) References Cited

U.S. PATENT DOCUMENTS

| | | | | | |
|---|---|---|---|---|---|
| 3,583,688 | A | * | 6/1971 | Fuqua et al. | 432/44 |
| 4,125,946 | A | * | 11/1978 | Prager | 34/80 |
| 4,231,166 | A | * | 11/1980 | McMillan | 34/553 |
| 4,498,317 | A | * | 2/1985 | Thysen et al. | 68/12.15 |
| 4,741,182 | A | * | 5/1988 | Didier et al. | 68/12.23 |
| 5,555,640 | A | * | 9/1996 | Ou | 34/202 |
| 5,560,124 | A | * | 10/1996 | Hart et al. | 34/493 |
| 5,897,672 | A | * | 4/1999 | Badami et al. | 8/159 |
| 2006/0055914 | A1 | | 3/2006 | Wojciechowski | |

FOREIGN PATENT DOCUMENTS

| | | |
|---|---|---|
| EP | 1441058 | 7/2004 |
| JP | 2002-357470 | 12/2002 |
| KR | 10-2006-0120412 | 11/2006 |
| KR | 10-2007-0116502 | 12/2007 |
| WO | WO 2008/075849 | 6/2008 |

* cited by examiner

*Primary Examiner* — Stephen M. Gravini
(74) *Attorney, Agent, or Firm* — McKenna Long & Aldridge LLP

(57) ABSTRACT

Disclosed is a liquid storage container and a clothes dryer having the same. The liquid storage container comprises: a reservoir installed at the clothes dryer, and configured to store liquid therein; a light transmitting window disposed above the reservoir; and a level indicator configured to be partially or wholly immersed into the liquid stored in the reservoir according to a level of the liquid. According to the amount of the liquid stored in the reservoir, an immersed degree of the level indicator into the liquid may become different. Accordingly, a user may easily and rapidly check a remaining amount of the liquid with his or her naked eyes.

16 Claims, 4 Drawing Sheets

LIQUID STORAGE CONTAINER AND CLOTHES DRYER HAVING THE SAME

RELATED APPLICATION

The present disclosure relates to subject matter contained in priority Korean Application No. 10-2008-0094954, filed on Sep. 26, 2008 and U.S. Patent Application No. 61/136,711, filed on Sep. 26, 2008, which are herein expressly incorporated by reference in its entirety.

BACKGROUND OF THE INVENTION

1. Field of the Invention

The present invention relates to a liquid storage container and a clothes dryer having the same, and particularly, to a liquid storage container capable of storing liquid material such as fragrant material sprayed into a drum of a clothes dryer, and the clothes dryer having the same.

2. Background of the Invention

In general, a clothes dryer indicates an apparatus for drying laundry having completely undergone a dehydration process after a washing process, by introducing the laundry into, a drum of the clothes dryer, and by evaporating moisture inside the laundry by supplying hot blast into the drum.

The clothes dryer comprises a drum disposed in the clothes dryer and into which laundry is introduced, a driving motor for driving the drum, a blow fan for blowing air into the drum, and a heating means for heating the air introduced into the drum.

The heating means may use high-temperature electric resistance heat generated by using an electric resistance, or combustion heat generated by combusting gas.

Air having been discharged from the drum contains moisture of the laundry inside the drum, thereby changing into high-temperature humid air. According to a method for processing the high-temperature humid air, the clothes drier may be classified. More concretely, the clothes drier is classified into a condensation type clothes dryer for condensing moisture inside high-temperature humid air by heat-exchanging the high-temperature humid air with external air through circulation in the clothes dryer without discharging the high-temperature humid air out of the clothes dryer, and an exhaustion type clothes dryer for directly discharging high-temperature humid air having passed through the drum to the outside.

When drawing the laundry having completely undergone a washing process out of a washing machine so as to introduce the laundry into the clothes dryer, a user may have discomfort in smelling odor of used washing water and detergent, or odor of the laundry prior to the washing process. Accordingly, it was required to supply fresh feeling of the laundry to the user by removing the odor of the laundry. For this end, there have been efforts to supply functional material such as fragrant material into the drum. The fragrant material to be stored in a storage container has to be supplied with an appropriate amount corresponding to a usage amount. Accordingly, there has been required a means to allow the user to conveniently check a remaining amount of the fragrant material inside the storage container.

SUMMARY OF THE INVENTION

Therefore, an object of the present invention is to provide a liquid storage container capable of storing liquid material and easily checking a remaining amount of the liquid material.

Another object of the present invention is to provide a clothes dryer having a liquid storage container capable of easily checking a remaining amount of liquid material.

To achieve these and other advantages and in accordance with the purpose of the present invention, as embodied and broadly described herein, there is provided a liquid storage container, comprising: a reservoir installed at a clothes dryer, and configured to store liquid therein; a light transmitting window disposed above the reservoir; and a level indicator disposed to form an acute angle with respect to the surface of the light transmitting window, and configured to be partially or wholly immersed into the liquid stored in the reservoir according to a level of the liquid.

According to the amount of the liquid stored in the reservoir, an immersed degree of the level indicator into the liquid may become different. Accordingly, a user may check a remaining amount of the liquid with his or her naked eyes. Especially, the level indicator may be disposed to form an acute angle with respect to the surface of the light transmitting window. Accordingly, even if the light transmitting window is located above the clothes dryer, the entire level indicator may be easily checked. This may allow the user to precisely and conveniently check the remaining amount of the liquid.

The level indicator may be implemented as a calibration display portion. The calibration display portion may include numbers or characters for providing information about a remaining amount of the liquid, on a side surface of a calibration.

The calibration display portion may be protruding from a bottom surface of the reservoir, or may be integrally formed with the reservoir.

The level indicator may be a plate-type calibration display portion. The plate-type calibration display portion may be separately formed from the reservoir. In this case, a lower side of the plate-type calibration display portion may be utilized as a storage space, which enhances a spatial utilization degree.

The level indicator may be arranged at the center of the reservoir, or may be arranged so as to contact an inner wall of the reservoir.

The liquid storage container may further comprise a guide groove extending along the level indicator, and a floating member which moves along the guide groove. Even in the case that transparent liquid is stored in the liquid storage container, an immersed degree of the level indicator into the transparent liquid may be easily checked by a user.

According to another aspect of the present invention, there is provided a liquid storage container, comprising: a reservoir installed at a clothes dryer, and configured to store liquid therein; a light transmitting window disposed above the reservoir; and a level indicator disposed to form an acute angle with respect to the surface of the liquid stored in the reservoir, and configured to be partially or wholly immersed into the liquid stored in the reservoir according to a level of the liquid.

According to still another aspect of the present invention, there is provided a clothes dryer, comprising: a body; a drum rotatably installed in the body; a liquid supplying apparatus configured to supply liquid material into the drum; and a liquid storage container comprising: a reservoir installed at the body, and configured to store liquid therein; a light transmitting window disposed above the reservoir; and a level indicator disposed to form an acute angle with respect to the surface of the light transmitting window, and configured to be partially or wholly immersed into the liquid stored in the reservoir according to a level of the liquid, wherein the liquid storage container may be one of the aforementioned liquid storage containers.

According to yet still another aspect of the present invention, there is provided a clothes dryer, comprising: a body; a drum rotatably installed in the body; a liquid supplying apparatus configured to supply liquid material into the drum; and a liquid storage container comprising: a reservoir installed at the body, and configured to store liquid therein; a light transmitting window disposed above the reservoir; and a level indicator disposed to form an acute angle with respect to the surface of the liquid stored in the reservoir, and configured to be partially or wholly immersed into the liquid stored in the reservoir according to a level of the liquid, wherein the liquid storage container may be one of the aforementioned liquid storage containers.

According to yet still another aspect of the present invention, there is provided a liquid storage container, comprising: a reservoir installed at a clothes dryer, and configured to store liquid therein; a light transmitting window disposed above, the reservoir; and, a level indicator installed in the reservoir, and configured to be partially or wholly immersed into the liquid stored in the reservoir according to a level of the liquid.

According to yet still another aspect of the present invention, there is provided a clothes dryer, comprising: a body; a drum rotatably installed in the body; a liquid supplying apparatus configured to supply liquid material into the drum; and a liquid storage container, wherein the liquid storage container comprises: a reservoir installed at the body, and configured to store liquid therein; a light transmitting window disposed above the reservoir; and a level indicator installed in the reservoir, and configured to be partially or wholly immersed into the liquid stored in the reservoir according to a level of the liquid.

In the present invention, an immersed degree of the level indicator into the liquid, stored in the reservoir may become according to a level of the liquid, which may be easily checked by a user. This may allow the user to conveniently and rapidly check a remaining amount of the liquid.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a liquid storage container and a clothes dryer having the same according to the present invention will be explained in more detail with reference to the attached drawings.

Figure 1:
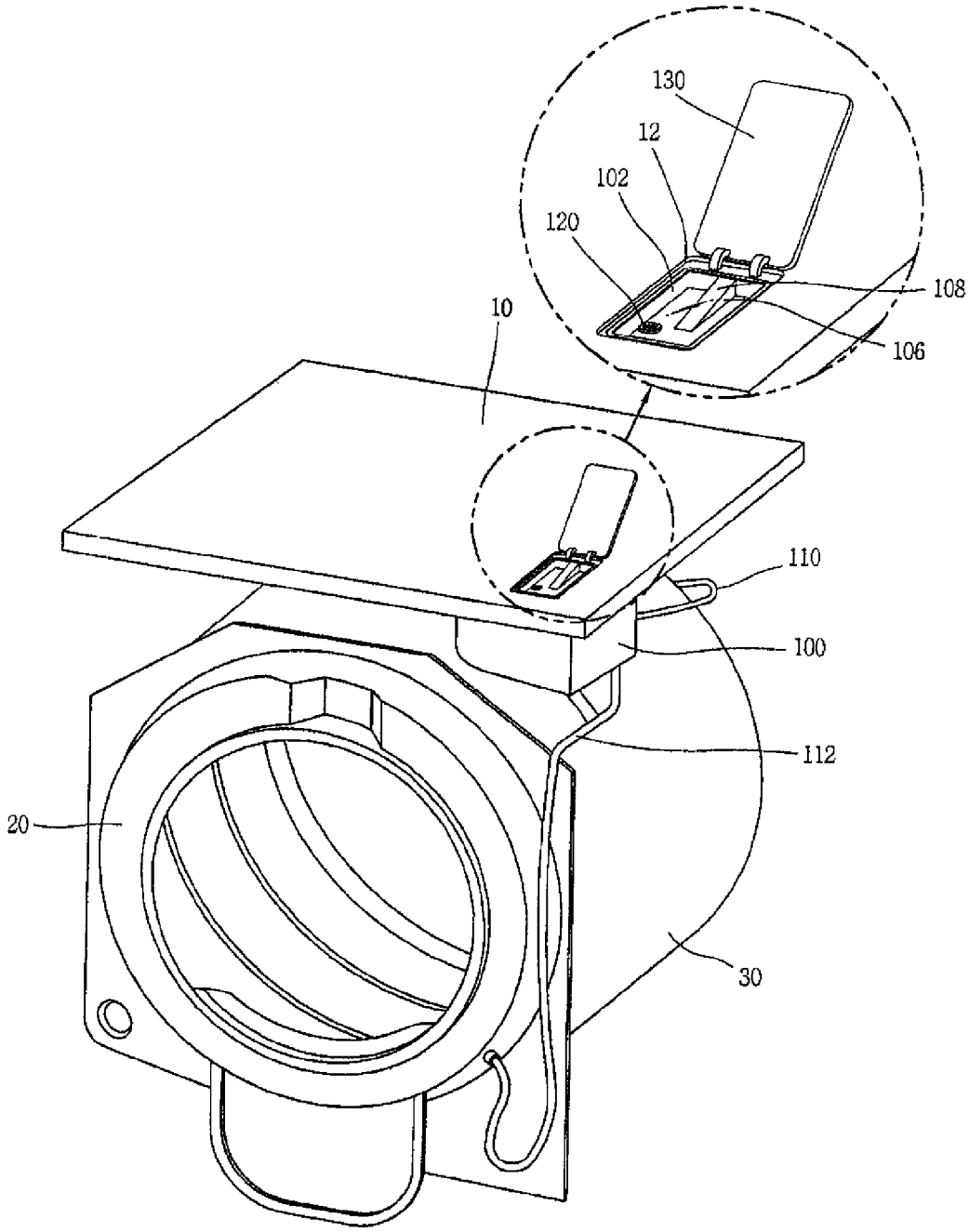
FIG. 1 is a perspective view of a clothes dryer having a liquid storage container according to a first embodiment of the present invention.
Figure 2:
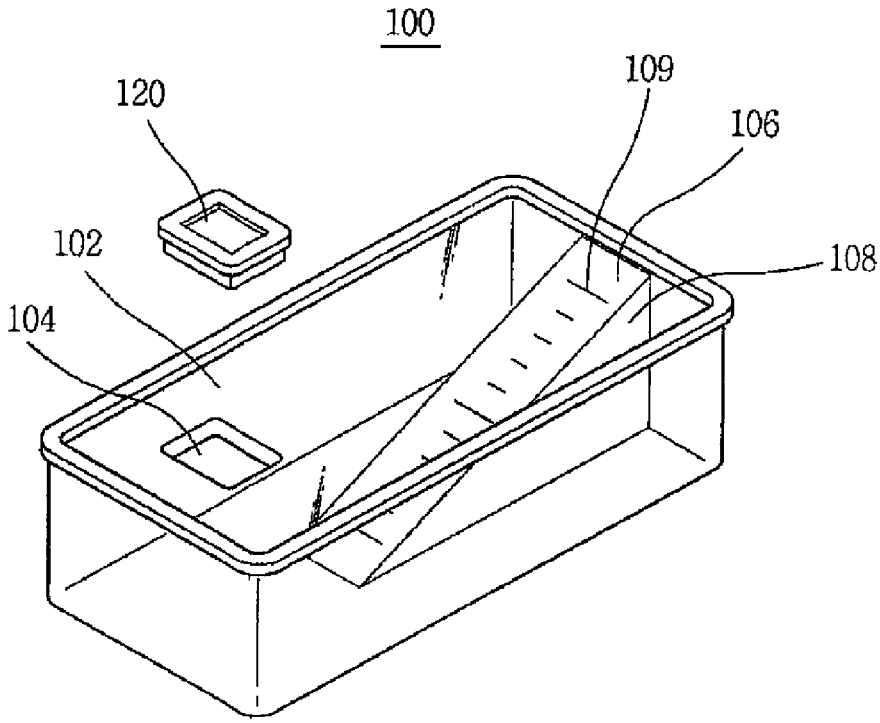
FIG. 2 is an enlarged perspective view of the liquid storage container of FIG. 1.
Figure 3:
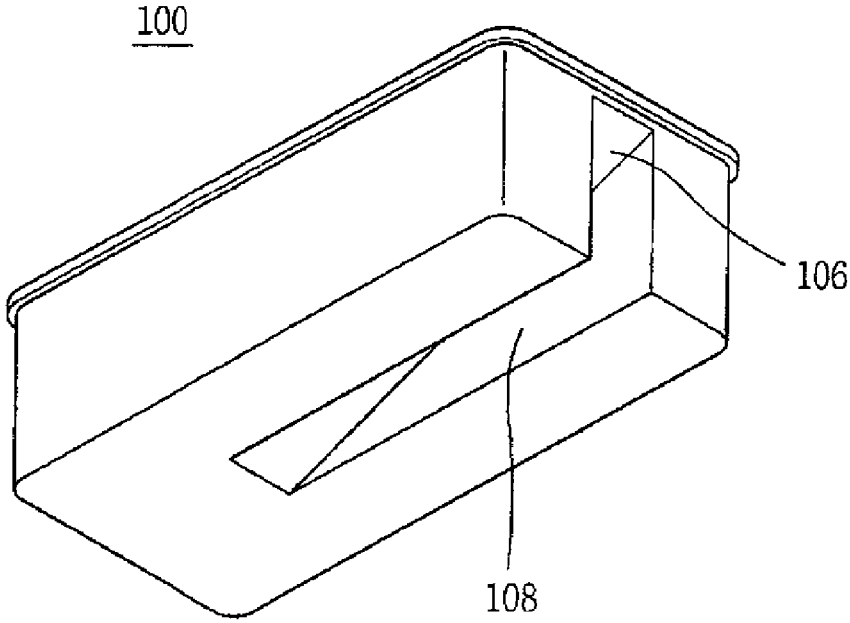
FIG. 3 is a perspective view of a bottom surface of the liquid storage container of FIG. 2.

FIGS. 1 to 3 show an inner structure of a clothes dryer having a liquid storage container according to a first embodiment of the present invention. FIG. 1 shows only an inner structure of the clothes dryer except for an outer panel. In the preferred embodiment of FIGS. 1 to 3, the liquid storage container has been applied to the clothes dryer. However, the liquid storage container may be also applied to any apparatus for containing specific liquid to be supplemented. For instance, the liquid storage container of FIG. 1. may be also applied to a washing machine having a drying function.

An upper side of the clothes dryer constitutes an upper plate 10. The upper plate 10 forms the appearance of the clothes dryer together with a front plate, side plates, and a rear plate. A front supporter 20 is disposed at a front side of the clothes dryer. The front supporter 20 is disposed on a front surface of a drum 30, and rotatably supports the drum 30 together with a rear supporter (not shown).

A reservoir 100 for storing fragrant material therein is installed on a bottom surface of the upper plate 10. The reservoir 100 may serve to store therein not only fragrant material, but also any liquid material. A fragrant material supplying pipe 110 connected to a nozzle (not shown) through which fragrant material is sprayed into the drum 30 is connected to one side surface of the reservoir 100. And, a fragrant material discharging pipe 112 is connected to a bottom surface of the reservoir 100. The fragrant material discharging pipe 112 serves to discharge fragrant material remaining in the reservoir 100 when other type of fragrant material is to be sprayed into the drum 30.

A cut-out portion 12 is disposed on the upper plate 10 at a position above the reservoir 100. The reservoir 100 is arranged so that a reservoir cover 102 can be exposed out through the cut-out portion 12. An introduction opening 104 is formed at the reservoir cover 102, and the introduction opening 104 may be opened or closed by a lid 120 A cover 130 configured to open or close the cut-out portion 12 is rotatably coupled to one side of the cut-out portion 12.

A central portion of the bottom surface of the reservoir 100 is upwardly protruding to form a calibration display portion 106. As both side walls 108 of the calibration display portion 106 are connected to the bottom surface of the reservoir 100, the calibration display portion 106 and the reservoir 100 are integrally formed with each other. Here, the calibration display portion 106 is arranged so that its surface can form an acute angle with respect to the surface of the reservoir cover 102 corresponding to an upper surface of the reservoir 100. Also, the surface of the calibration display portion 106 forms an acute angle with respect to the surface of liquid stored in the reservoir 100. The angle may be determined according to a height and a width of the reservoir 100. For instance, the calibration display portion 106 may be arranged so as to have a length corresponding to ⅔ of a length of the bottom surface of the reservoir 100 or more than.

Preferably, the introduction opening is arranged in a direction perpendicular to the calibration display portion 106 without overlapping each other. This may prevent liquid put into the introduction opening for supplementation from colliding with the surface of the calibration display portion 106 thereby dispersing out.

Calibrations 109 are formed on the surface of the calibration display portion 106. Alternatively, the surface of the calibration display portion 106 may be divided into a plurality of regions, and the regions may be set to have different colors from each other. As another example, information corresponding to calibrations, such as substantial numeric values or maximum or minimum values may be displayed near the calibration.

Hereinafter, the operation of the liquid storage container will be explained in more detail.

Once fragrant material is put in the reservoir 100, the calibration display portion 106 is partially or entirely immersed into the fragrant material according to a level of the fragrant material. For instance, when the fragrant material is filled-up in the reservoir 100, the upper side of the calibration display portion 106 has a maximum level. However, as the fragrant material is continuously used, the level of the calibration display portion 106 is gradually lowered.

A user can periodically check a remaining amount of the fragrant material, and can supplement the fragrant material by opening the cover 130. Since the reservoir 100 is disposed on the upper plate 10, the user's eyes are toward the lower side from the upper side of the reservoir cover 102. Since the calibration display portion 106 is arranged so as to form an acute angle with respect to the surface of the reservoir cover 102, an angle between the user's eyes and the surface of the calibration display portion 106 becomes close to a right angle. Accordingly, the user can easily check a remaining amount of the fragrant material. This is more facilitated when the reservoir has a higher height and a narrower width.

In the case that the fragrant material is transparent, the user may have a difficulty in recognizing the level of the calibration display portion. For this, a guide groove extending in a lengthwise direction of the calibration display portion may be formed at the center of the calibration display portion. And, a floating member slid along the guide groove may be installed in the guide groove. Since the floating member precisely informs the level of the fragrant material, the user can more easily check the remaining amount of the fragrant material.

Figure 4:
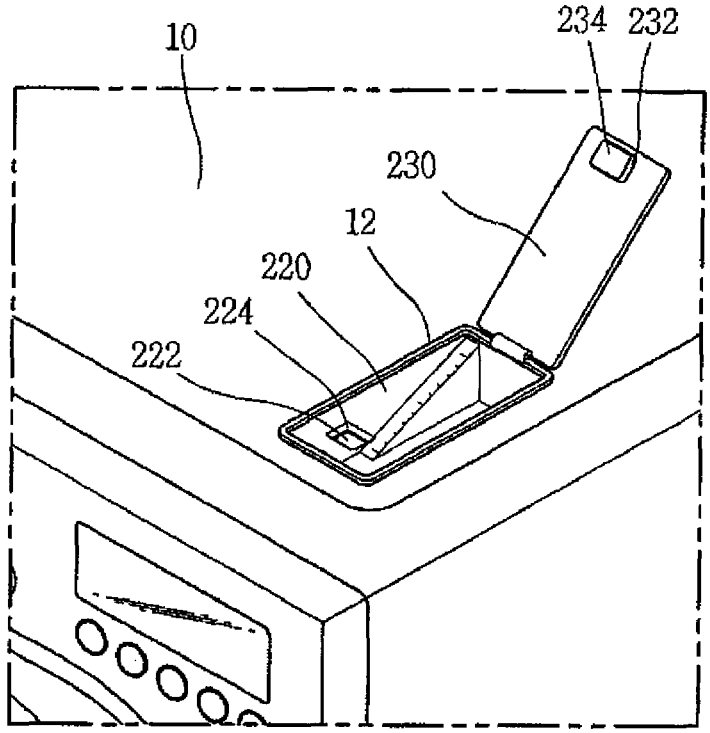
FIG. 4 is a perspective view of a clothes dryer having a liquid storage container according to a second embodiment of the present invention.
Figure 5:
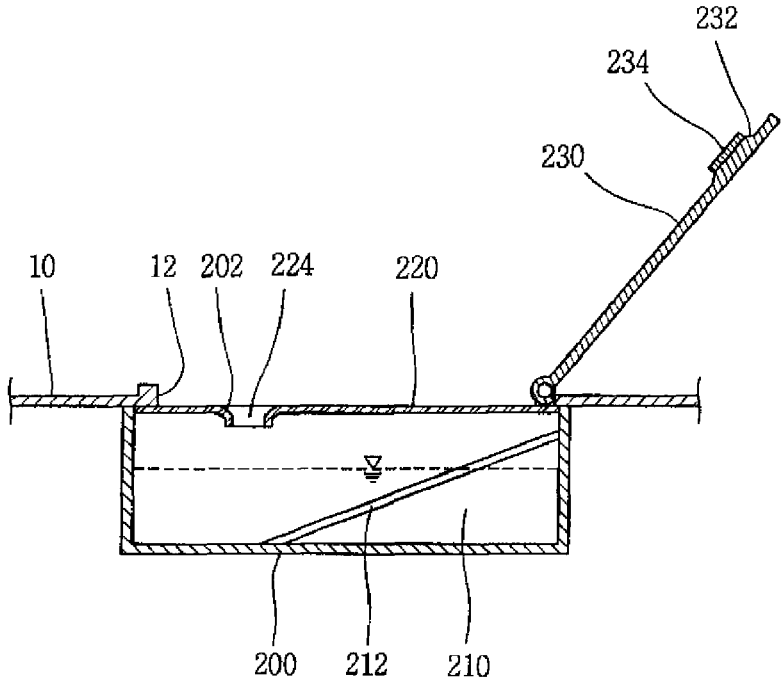
FIG. 5 is a sectional view of the liquid storage container of FIG. 4.

FIG. 4 is a perspective view of a clothes dryer having a liquid storage container according to a second embodiment of the present invention, which shows only the upper plate 10 of the clothes dryer.

A cut-out portion 12 is formed at a part of the upper plate 10, and a reservoir 200 is fixed to a bottom surface of the cut-out portion 12. Here, the reservoir 200 may be integrally formed with the upper plate 10. The reservoir 200 has an opened upper surface, and a calibration display portion 210 is formed at one side of the reservoir 200 so as to be protruding from a bottom surface of the reservoir 200. The calibration display portion 210 is integrally formed with the reservoir 200. And, a calibration plate 212 having a plurality of calibrations thereon is attached onto an upper surface of the calibration display portion 210. The calibration plate 212 is formed of a different material, or is formed to have a different color from the calibration display portion 210. This may allow the user to more efficiently check the calibrations. It is also possible to directly form calibrations on the surface of the calibration display portion 210 without forming the calibration plate 212.

A cover plate 220 formed of a transparent or semi-transparent material is mounted to the opened upper surface of the reservoir 200. The cover plate 220 includes an orifice portion 222 and an opening 224. The orifice portion 222 prevents liquid for supplementation from flowing to an upper surface of the cover plate 220. A cover 230 is rotatably installed at one side of the cut-out portion 12. And, the cover 230 includes a protrusion 232 having a shape corresponding to the orifice portion 222, and a seal 234 for blocking the opening 224. The opening can be easily opened just by opening the cover 230 including the sealing 234.

In the preferred embodiment, the calibration display portion 210 is positioned below the calibration plate 212. However, only the calibration plate 212 may be fixed to a side wall of the reservoir 200 without implementing the calibration display portion 210. In this case, a spatial utilization degree of the inside of the reservoir 200 can be enhanced.

Figure 6:
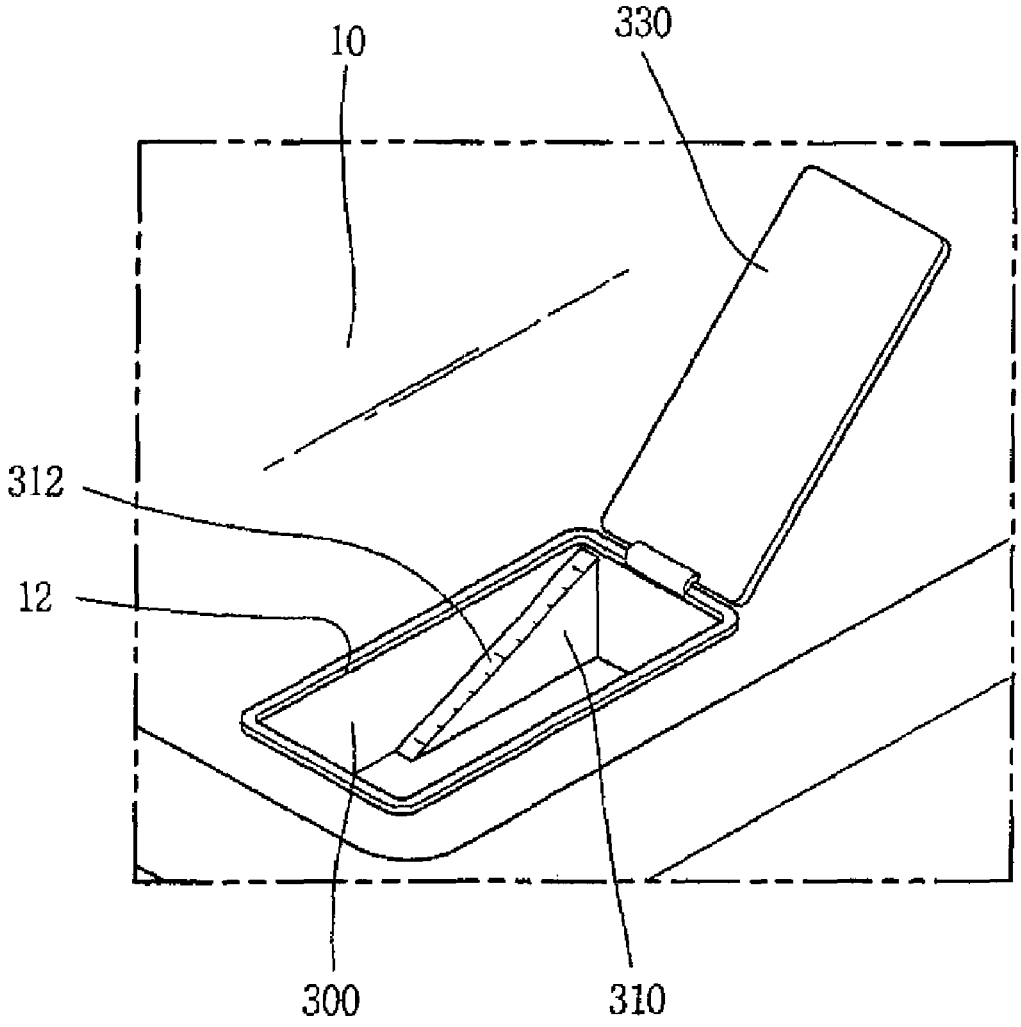
FIG. 6 is a cut-out perspective view of a clothes dryer having a liquid storage container according to a third embodiment of the present invention.

Referring to FIG. 6, a reservoir 300 can be opened or closed by a cover 330 hinge-coupled to the cut-out portion 12 without implementing the cover plate. The reservoir 300 includes a calibration display portion 310 protruding from a bottom surface of the reservoir 300, and a calibration plate 312 attached onto the calibration display portion 310.

In the aforementioned embodiments, the calibration display portion serving as the level indicator is arranged so as to be inclined with respect to the upper surface of the reservoir, or the surface of the cover plate and the liquid. However, calibrations may be directly formed on an inner wall of the reservoir, which simplifies the structure of the reservoir. As the upper surface of the reservoir or the surface of the cover plate may be arranged so as to be inclined with respect to the liquid stored in the reservoir, the user's wide viewing angle may be obtained.

The foregoing embodiments and advantages are merely exemplary and to are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A liquid storage container, comprising: a reservoir installed at a clothes dryer, and configured to store liquid therein; a light transmitting window disposed above the reservoir; and a level indicator disposed to form an acute angle with respect to the surface of the light transmitting window, and configured to be partially or wholly immersed into the liquid stored in the reservoir according to a level of the liquid.

2. The liquid storage container of claim 1, wherein the level indicator is implemented as a calibration display portion including a plurality of calibrations.

3. The liquid storage container of claim 2, wherein the calibration display portion is protruding from a bottom surface of the reservoir.

4. The liquid storage container of claim 3, wherein the calibration display portion is integrally formed with the reservoir.

5. The liquid storage container of claim 1, wherein the level indicator is a plate-type calibration display portion.

6. The liquid storage container of claim 1, wherein the level indicator is arranged at the center of the reservoir.

7. The liquid storage container of claim 1, further comprising: a guide groove extending along the level indicator; and a floating member which moves along the guide groove.

8. A liquid storage container, comprising: a reservoir installed at a clothes dryer, and configured to store liquid therein; a light transmitting window disposed above the reservoir; and a level indicator disposed to form an acute angle with respect to the surface of the liquid stored in the reservoir, and configured to be partially or wholly immersed into the liquid stored in the reservoir according to a level of the liquid.

9. The liquid storage container of claim 8, wherein the level indicator is implemented as a calibration display portion including a plurality of calibrations.

10. The liquid storage container of claim 9, wherein the calibration display portion is protruding from a bottom surface of the reservoir.

11. The liquid storage container of claim 10, wherein the calibration display portion is integrally formed with the reservoir.

12. The liquid storage container of claim 8, wherein the level indicator is a plate-type calibration display portion.

13. The liquid storage container of claim 8, further comprising: a guide groove extending along the level indicator; and a floating member which moves along the guide groove.

14. A liquid storage container, comprising: a reservoir installed at a clothes dryer, and configured to store liquid therein; a light transmitting window disposed above the reservoir; and a level indicator installed in the reservoir, and configured to be partially or wholly immersed into the liquid stored in the reservoir according to a level of the liquid.

15. The liquid storage container of claim 8, wherein the level indicator disposed to form an acute angle with respect to the surface of the light transmitting window.

16. The liquid storage container of claim 8, wherein the level indicator is arranged at the cento for the reservoir.

* * * * *